US011597005B2

(12) United States Patent
Przeslawski et al.

(10) Patent No.: US 11,597,005 B2
(45) Date of Patent: Mar. 7, 2023

(54) CONTROLLED GRAIN MICROSTRUCTURES IN CAST ALLOYS

(71) Applicant: General Electric Company, Schenectady, NY (US)

(72) Inventors: Brian David Przeslawski, Liberty Township, OH (US); Manuel Acosta, Blue Ash, OH (US); Douglas Gerard Konitzer, West Chester, OH (US); Joshua Leigh Miller, West Chester, OH (US); Adegboyega Masud Makinde, Austin, TX (US)

(73) Assignee: General Electric Company, Schenectady, NY (US)

( * ) Notice: Subject to any disclaimer, the term of this patent is extended or adjusted under 35 U.S.C. 154(b) by 380 days.

(21) Appl. No.: 16/593,423

(22) Filed: Oct. 4, 2019

(65) Prior Publication Data

US 2021/0069777 A1 Mar. 11, 2021

Related U.S. Application Data

(60) Provisional application No. 62/818,247, filed on Mar. 14, 2019, provisional application No. 62/741,794, filed on Oct. 5, 2018.

(51) Int. Cl.

| | |
|---|---|
| ***B22D 15/00*** | (2006.01) |
| ***F01D 5/14*** | (2006.01) |
| ***F01D 5/28*** | (2006.01) |

(52) U.S. Cl.

CPC ..... *B22D 15/00* (2013.01); *F01D 5/147* (2013.01); *F01D 5/28* (2013.01)

(58) Field of Classification Search

CPC ..... B22D 15/00; B22D 27/04; B22D 27/045; B22D 27/13; B22D 27/15; B22D 27/20; F01D 5/147; F01D 5/28; B22C 9/04

See application file for complete search history.

(56) References Cited

U.S. PATENT DOCUMENTS

| | | | |
|---|---|---|---|
| 3,008,855 | A | 11/1961 | Swenson |
| 3,248,764 | A | 5/1966 | Chandley |
| 3,283,377 | A | 11/1966 | Chandley |
| 3,336,970 | A | 8/1967 | Watts et al. |
| 3,913,660 | A | 10/1975 | Diez |
| 3,942,581 | A | 3/1976 | Sawyer |
| 4,240,495 | A | 12/1980 | Vonnegut |
| 4,813,470 | A | 3/1989 | Chiang |
| 4,832,112 | A | 5/1989 | Brinegar et al. |
| 6,251,335 | B1 | 6/2001 | Messing et al. |
| 6,634,413 | B2 | 10/2003 | Ray et al. |
| 6,695,034 | B2 | 2/2004 | Graham |
| 6,705,385 | B2 | 3/2004 | Ray et al. |
| 2013/0160967 | A1 | 6/2013 | Suzuki et al. |

OTHER PUBLICATIONS

International Search Report Corresponding to Application No. PCT/US2019/054707 dated Jun. 26, 2020.

*Primary Examiner* — Moshe Wilensky
(74) *Attorney, Agent, or Firm* — Dority & Manning, P.A.

(57) ABSTRACT

Methods for creating a cast component, along with the resulting cast components, are provided. The method may provide for a controlled grain structure in the resulting cast component. The methods may include heating at least a first portion mold under controlled conditions, such as when the first portion of the mold is buried in a ceramic powder.

15 Claims, 8 Drawing Sheets

CONTROLLED GRAIN MICROSTRUCTURES IN CAST ALLOYS

PRIORITY INFORMATION

The present application claims priority to U.S. Provisional Patent Application Ser. No. 62/741,794 filed on Oct. 5, 2018 and to U.S. Provisional Patent Application Ser. No. 62/818,247 filed on Mar. 14, 2019. These disclosures are incorporated by references herein.

FIELD

This disclosure is generally related to metallic components, and methods for manufacturing those components. In some specific embodiments, the disclosure is related to cast metallic articles, often formed from nickel- or cobalt-based superalloys; and related, specialized casting methods.

BACKGROUND

A number of metals and metal alloys are employed in demanding applications, in terms of strength, oxidation resistance, and/or high temperature resistance. Examples include titanium, vanadium, molybdenum, and superalloys based on nickel, cobalt, or iron. Such superalloys are especially suitable for high-temperature applications, such as, for example, gas turbine engine components of aircraft engines and power generation equipment. Very often, these components are manufactured by casting processes, such as investment-casting. While metal casting has been practiced for thousands of years, the techniques have become quite sophisticated in modern times, due in part to the high level of integrity required for cast parts such as jet engine blades.

The integrity and overall quality of the metal component is determined in part by its crystalline structure, e.g., the grain size and orientation of the grains in the component. The desired grain structure is, in turn, often dependent on the projected operating temperature of the part. As an example in the case of gas turbine components formed from various superalloys, the turbine blades in the turbine section may be exposed to extremely hot temperatures, and may have a directionally solidified (DS) columnar grain structure, or a single crystal structure, to resist high-temperature creep failure and other degrading effects.

In contrast, engine components that are subjected to lower operating temperatures often benefit from a very different grain structure. For example, gas turbine wheels and discs, while having their own set of performance requirements, often operate at temperatures much lower than those encountered within the hot gas path. In many cases, it is very desirable that these components have a fine equiaxed grain structure.

Although fine equiaxed grain structures are commonly obtained in small castings, they are relatively difficult to produce in large, complex parts, such as the gas turbine airfoils and structural components. The investment casting techniques typically produce cast components having a mixture of columnar and equiaxed grains. This is often the case for large components with thick sections (e.g., sections more than about 10 mm thick). Obtaining the desired fine-grain structure can be especially difficult if the component has a complex geometry, with a wide variation in sectional thickness.

Non-uniform grain morphology and grain size can lead to problems in the quality and performance of the cast components. In many cases (though not all), large grain size can result in low strength at a given operating temperature. Moreover, a columnar grain structure, while desirable for components operating under a specific temperature regime, can be detrimental for the lower-temperature components referenced above. Columnar grain morphology is characterized by continuous, intergranular boundaries, along which cracks and "hot tears" can sometimes develop. Also, when oriented transversely to the stress-direction during use, the columnar grain boundaries can be weak, which can in turn lead to premature failure of the component.

Alternatively, certain components may be used in ways that expose different sections of the cast component to different environments in use. In such components, it may be desirable to have different grain properties within the different sections of the component. It is currently difficult to produce components with multiple material structures in a single process. In many cases separate parts with different structures are joined to produce a structure.

With these general considerations in mind, new methods for casting high-performance alloys would be welcome in the art. The techniques should be especially suitable for manufacturing components that require a controlled microstructure, such as fine equiaxed grain structures or multi-type grain structure in different sections of the component. Moreover, the new developments should also be suitable for casting relatively large components having complex geometries. Furthermore, the techniques should not require substantial changes to current casting operations that would result in significant increases in manufacturing costs.

BRIEF DESCRIPTION

Aspects and advantages will be set forth in part in the following description, or may be obvious from the description, or may be learned through practice of the invention.

Method are generally provided for creating a cast alloy component from a metal material having a solidus temperature and a liquidus temperature. In one embodiment, the method includes: burying at least a first portion of a mold in a powder of ceramic material; heating the mold within the powder of ceramic material; thereafter, pouring molten metal material into the mold while the first portion is buried in the powder of ceramic material; and thereafter, allowing the molten metal material to form the cast alloy component within the mold while the first portion is buried within the powder of ceramic material.

Cast alloys are also generally provided, including the components formed therefrom. In particular embodiments, the cast alloy component may have different sections having different grain microstructures (e.g., a bladed disk).

These and other features, aspects and advantages will become better understood with reference to the following description and appended claims. The accompanying drawings, which are incorporated in and constitute a part of this specification, illustrate embodiments of the invention and, together with the description, serve to explain certain principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended FIGS., in which.

Figure 1:
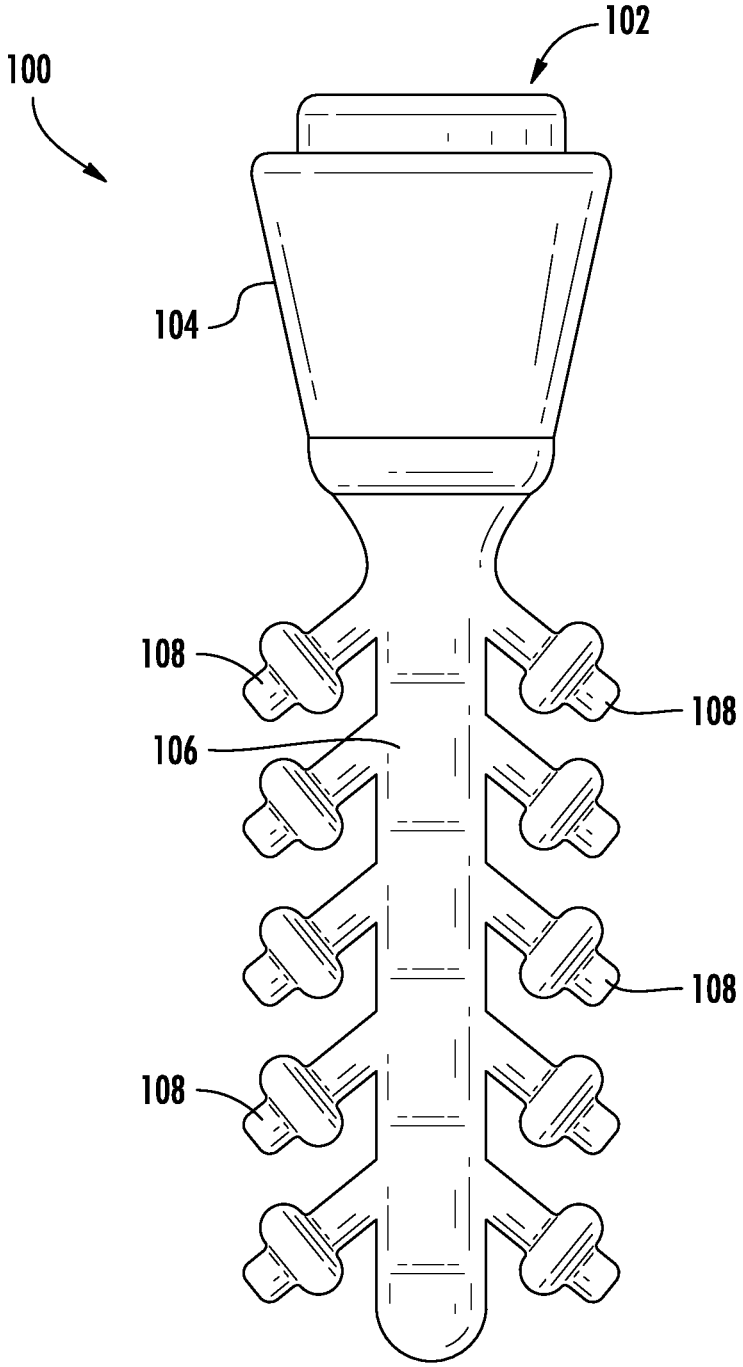
FIG. 1 shows an exemplary mold having a plurality of component cast portions extending from a center channel.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

As alluded to previously, a number of metals and metal alloys can be cast according to embodiments of this invention. Examples include the "superalloys," a term intended to embrace iron-, cobalt-, or nickel-based alloys. The superalloys usually include one or more additional elements to enhance their high-temperature performance. Non-limiting examples of the additional elements include cobalt, chromium, aluminum, tungsten, molybdenum, rhenium, ruthenium, zirconium, carbon, titanium, tantalum, niobium, hafnium, boron, silicon, yttrium, and the rare earth metals. (Each of the base alloys may contain one or more of the other elements listed as base alloys, e.g., nickel-based alloys containing cobalt and/or iron). Other metals that can be cast according to methods described herein include titanium or titanium alloys, or stainless steel alloys.

Methods for creating a cast component from a metal material are generally provided herein, along with the resulting cast components. In particular embodiments, the method includes forming cast components with a controlled grain structure therein.

I. Growth of Fine Grain Structures

In one embodiment, methods are provided for creating a cast alloy component from a metal material. Generally, the methods involve burying a mold in a powder of ceramic material, preheating the mold to an initial mold temperature, and then pouring the molten metal material into the mold while the mold is buried within the powder. Then, the molten metal material may be allowed to cool to form a cast alloy component while the mold is buried within the powder of ceramic material.

Through this method, the resulting cast alloy component has a grain structure that is predominantly fine grains across thin and thick sections with little to no columnar grain growth. Such a finer grain structure leads to superior properties (e.g. increased fatigue life) of cast alloy components for particular applications, such as compressor blades. For example, the cast alloy component may have a grain structure that has an average grain size of about 250 micrometers (μm) or less, such as about 10 μm to about 250 μm (e.g., about 25 μm to about 200 μm, or about 25 μm to about 100 μm).

Without wishing to be bound by any particular theory, it is believed that the methods help achieve significantly fine grain structure across the cast alloy component by decreasing the thermal gradient within the metal material during final solidification. Without wishing to be bound by any particular theory, it is believed that the ceramic bed provides a medium into which the thermal gradient is formed, outside of the mold, to allow for more unified cooling within the mold. That is, a thermal gradient can be formed within the powder of ceramic material after poring the molten metal material into the mold, such that the thermal gradient essentially shifts from the metal material within the mold and into the ceramic powder outside of the mold. As such, the resultant grain structure within the cast alloy component has a substantially uniform grain structure across thin and thick sections with little to no columnar grain growth.

In one particular embodiment, the ceramic material of the powder is an insulating ceramic material (e.g., insulating ceramic oxides). For example, in one embodiment, the ceramic material of the powder may include alumina (e.g., tabular alumina), which has a relatively high thermal conductivity of the insulating ceramic material. Such a feature may provide a path to conduct heat throughout the powder so as to minimize any thermal gradient across the mold, keeping the metal material and the ceramic material at substantially the same temperature through the cooling process. Other insulating ceramic oxides that may be suitable for use as the ceramic material of the powder include, but are not limited to, zirconia, hafnia, titania, silica, cobalt aluminate, zircon, silica, magnesia, a rare earth oxide (e.g., yttria), or mixtures thereof.

The ceramic material of the powder generally comprises a plurality of ceramic particles (i.e., a powder of ceramic particles). In certain embodiments, the powder has relatively small sized particles (e.g., an average particle size of about 10 mm or less, preferably about 1 mm or less) such that maximum contact can be made with the exterior surfaces of the mold. In particular embodiments, the particles may have an average particle size of about 0.25 mm to about 0.85 mm.

Additionally, it is believed that the grain size may be controlled through adjusting the initial mold temperature, the material temperature of the molten material, and/or the elevated mold temperature reached after pouring the metal material therein. In one particular embodiment, the mold may be buried into a powder of ceramic material, and then the mold may be heated to the initial mold temperature. After heating to the initial mold temperature, the heat source may be disengaged, and the molten metal material may be poured into the mold while at the initial mold temperature.

In one embodiment, the initial mold temperature is less than half of the solidus temperature of the metal material to be poured therein. As used herein, the term "solidus temperature" refers to the highest temperature at which the metal material (e.g., an alloy) is completely solid. In one embodiment, the mold temperature may be 50% of the solidus temperature of the metal material or less (e.g., room temperature (e.g., 20° C. to 50% of the solidus temperature of the metal material). For example, the mold temperature may be 5% of the solidus temperature to 50% of the solidus temperature of the metal material (e.g., 7% to less than 30% of the solidus temperature of the metal material), such as 10% to 25% of the solidus temperature of the metal material. When the mold temperature less than half of the solidus temperature of the metal material, it is believed that the molten material quickly cools from its liquid phase upon being poured into the mold. As such, it is believed that the molten material may begin to crystalize while it fills the mold such that the molten metal material begins to form its grain structure upon pouring. Without wishing to be bound by any particular theory, it is believed that these grains may serve as seed sites for grain formation at the desired size. Such an embodiment may be particularly useful for components having large cavities to fill with the molten metal material.

While the molten metal is being poured into the cooler mold, it is believed, without wishing to be bound by any particular theory, that thermal energy transfers from the metal material to the mold, and then from the mold into the powder of ceramic material. That is, the metal material cools while the mold heats, which in turn causes the ceramic material surrounding the mold to heat. It is believed that the powder of ceramic material has sufficient thermal mass to absorb the heat from the metal material (through the mold), serving as a thermal sink, while providing insulation to the mold to control the cooling rate.

Generally, this controlled solidification process is allowed to occur until the metal material completely solidifies within the mold. As discussed below, the mold may then be quickly cooled, upon complete solidification of the metal material, to inhibit grain growth within the cast metal component. During the controlled solidification process, the molten material heats the mold from its initial mold temperature (i.e., the temperature of the mold when the molten material is poured therein) to an elevated mold temperature upon which the molten material is completely solidified within the mold. The elevated mold temperature may depend on a variety of factors, such as the initial mold temperature, the volume and/or temperature of the molten material at pouring, the amount and/or type of ceramic material present, the size and/or thickness of the mold, etc. For example, in certain embodiments, the elevated mold temperature may be greater than 50% of the solidus temperature of the metal material (e.g., greater than 50% to 85% of the solidus temperature). For instance, the elevated mold temperature may be 55% to 80% of the solidus temperature of the metal material (e.g., 60% to 75% of the solidus temperature).

The mold may be made out of a ceramic material, which is independently selected from the ceramic material of the powder. For example, the mold may be formed from alumina, zirconia, hafnia, titania, silica, cobalt aluminate, zircon, silica, magnesia, a rare earth oxide, or a mixture thereof.

In certain embodiments, the molten metal material is poured into the mold near its liquidus temperature. As used herein, the term "liquidus temperature" refers to the lowest temperature at which the metal material (e.g., an alloy) is completely liquid. For example, the molten metal material is poured at a pour temperature may be about 80% of the liquidus temperature to 105% of the liquidus temperature of the metal material, such as about 85% of the liquidus temperature to 105%. When the pour temperature is at or above the liquidus temperature (e.g., 100% to about 105%) of the metal material, it is believed that the molten material may stay completely in the liquid phase while the mold is being filled such that the molten metal material completely fills the mold in a substantially uniform manner. Such an embodiment may be particularly useful for components having small structures through which the molten metal material fills. Alternatively, with the pour temperature is below the liquidus temperature (e.g., about 80% to less than 100%, such as about 90% to less than 100% or about 95% to less than 100%) of the metal material, it is believed that the molten material may begin to crystalize while it fills the mold such that the molten metal material begins to form its grain structure upon pouring. That is, crystals may form within the molten metal material, when the pour temperature is lower than the liquidus temperature, such that smaller grains already started prior to the rest of the material crystalizing. Without wishing to be bound by any particular theory, it is believed that these grains may serve as seed sites for grain formation at the desired size. Such an embodiment may be particularly useful for components having large cavities to fill with the molten metal material.

In one embodiment, the metal material may include, but is not limited to, pure metals, nickel alloys, chrome alloys, titanium, titanium alloys, magnesium, magnesium alloys, aluminum, aluminum alloys, nickel-based superalloys, cobalt-based superalloys, or mixtures thereof.

Referring to FIG. 1, a mold 100 is generally shown having an inlet 102 for receiving molten metal material. A funnel portion 104 is connected to a center channel 106, which directs the molten metal material to flow into the mold. A plurality of component cast portions 108 extend from the center channel 106 so as to form multiple components in a single casting cycle.

Figure 2:
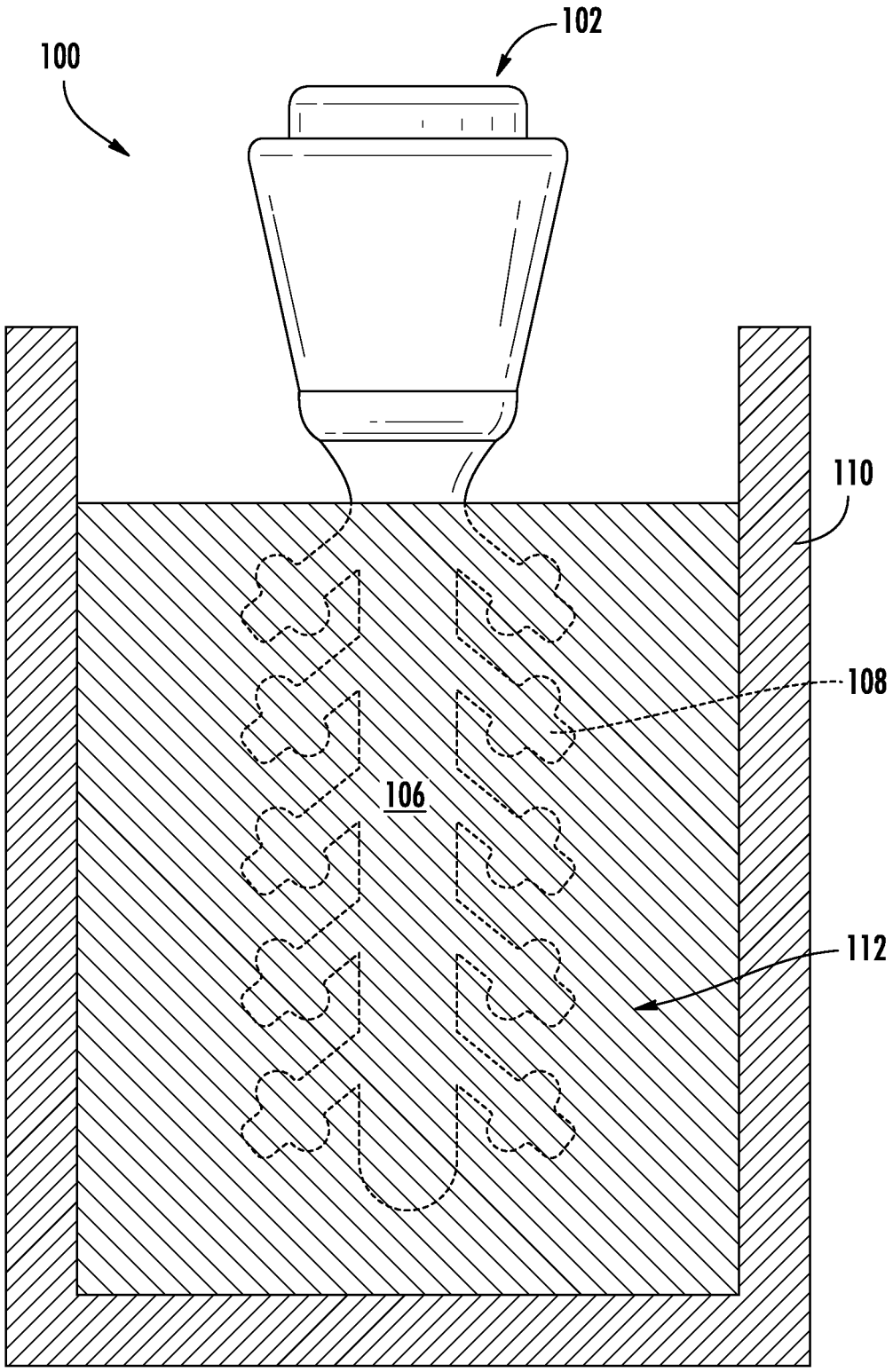
FIG. 2 shows the exemplary mold of FIG. 1 buried within a powder of ceramic material.

FIG. 2 shows the mold 100 placed into a carrier 110 and surrounded by a powder 112. As shown, all of the component cast portions 108 of the mold 100 are completely buried in the powder 112 of ceramic material. However, in other embodiments, only a portion of the component cast portions 108 are buried within the powder 112 of the ceramic material. In such a method, the grain size of the cast alloy components formed within the mold will have a small grain size in the component portions buried within the powder, while the cast alloy components formed within the mold will have larger grain sizes in the component portions above the powder.

In certain embodiments, the amount of powder 112 that is present in the carrier 110 is greater, in terms of thermal mass, than the amount of metal material poured into the mold 100. For example, thermal mass ratio may be defined by the volume of ceramic material to the volume of metal material within the mold. In this definition, the thermal mass ratio may be greater than 1, indicating that there is more thermal mass of the powder 112 than the poured metal material. In particular embodiments, the thermal mass ratio may be about 2 or greater (e.g., about 5 or greater, such as about 10 or greater).

Figure 3:
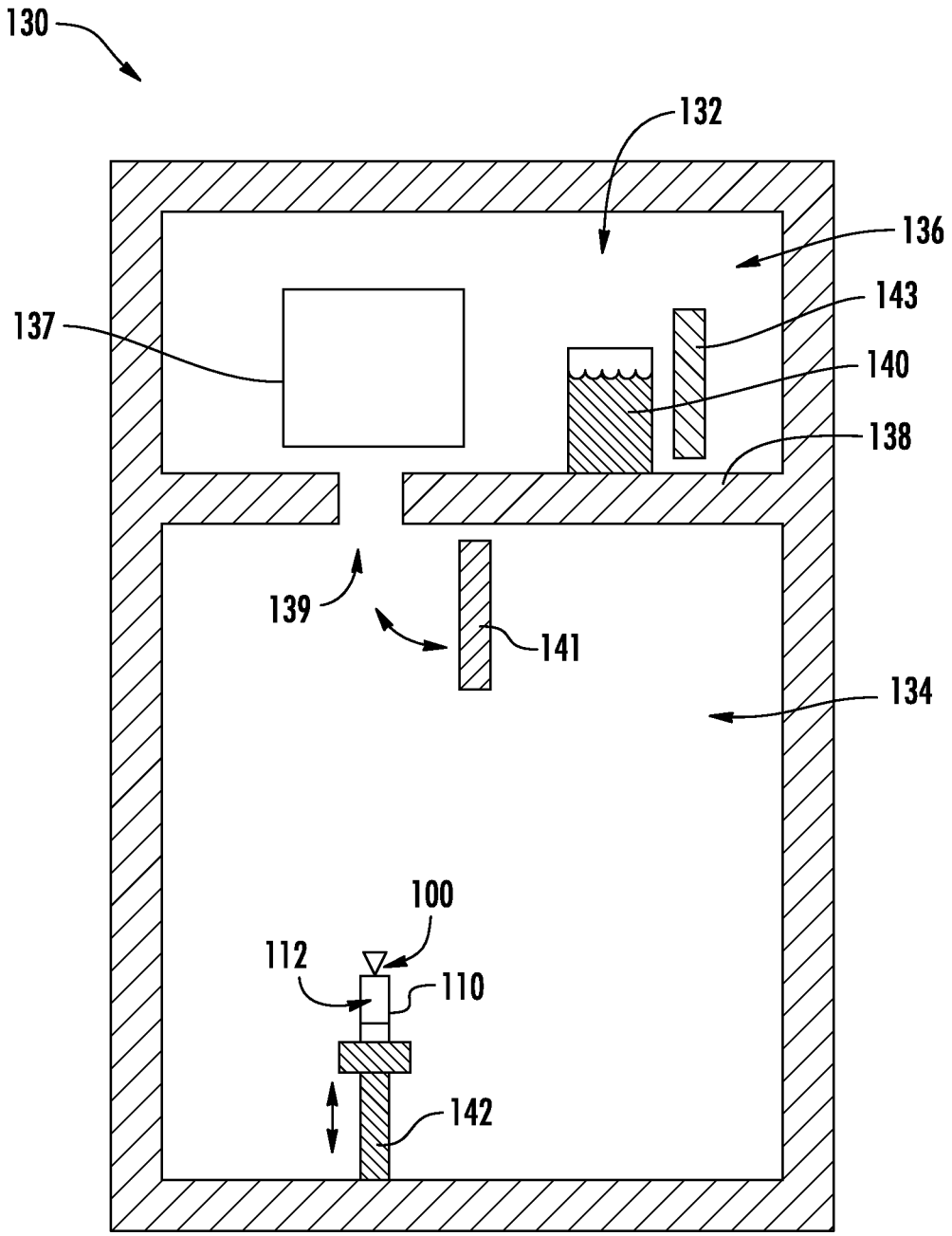
FIG. 3 shows an exemplary vacuum induction melter that may be used with the buried mold of FIG. 2.

FIG. 3 shows an exemplary vacuum induction melter 130 that is particularly suitable for forming the cast components. In the embodiment shown, a chamber 132 defines a loading area 134 and a pouring area 136 separated from each other by an inner wall 138. In the loading area 134, the mold 100 may be placed on the lift 142, and then lifted, while remaining buried within the powder 112, into the pouring area 136 through an aperture 139 between the loading area 134 and the pouring area 136. As shown, a valve arm 141 may close the aperture 139 in order to separate the loading area 134 from the pouring area 136. For example, the valve arm 141 may pivot to close the aperture 139. In other embodiments, the valve arm 141 may be configured to slide into place to close the aperture 139.

The mold heater 137 may preheat the mold, while buried within the ceramic material, to the initial mold temperature, as discussed above). Additionally, a metal heater 143 may heat the metal material 140 to the pour temperature within the pouring area 136 (e.g., about 90% of the liquidus temperature up to about 120% of the liquidus temperature, as discussed above). Then, the molten metal material 140 may be poured into the mold 100 while it remains buried within the powder 112 of ceramic material.

In one embodiment, the chamber 132 may be free from oxygen during pouring of the molten metal material 140 so as to prevent oxidation of the metal material. In certain embodiments, a vacuum may be formed within the chamber 132 for pouring of the molten metal material 140. For example, the chamber 132 may have a pressure that is less than 760 torr (e.g., about 300 torr or less). In particular embodiments, the chamber may have a pressure that is about 1 torr or less (e.g., about 0.1 millitorr to about 25 millitorr). In conditions having a pressure that is greater than 1 torr, it may be preferable to have an inert gas (e.g., argon) purge the chamber prior to drawing the vacuum so as to ensure that the atmosphere is substantially free from oxygen.

After pouring of the molten metal material 140, the molten metal material 140 is cooled within the mold 100 while buried within the powder 112 of ceramic material, through thermal transfer of the thermal energy from the metal material into the mold and, subsequently into the ceramic material. In certain embodiments, cooling may begin soon after the mold 100 is filled with the molten metal material 140. For example, upon completion of pouring, the mold 100 may be lowered back into the loading area 134 without any heating elements being used (i.e., any heating sources are disengaged). For example, the valve arm 141 may close the aperture 139 such that the loading area is isolated from the heating elements 137 and 143 in the pouring area 136. As such, the metal material 140 may be allowed to cool within the mold 100 while remaining buried within the powder 112 of ceramic material. Once the metal material 140 solidifies completely within the mold 100 (e.g., at an elevated mold temperature), the mold 100 may be cooled quickly to inhibit grain growth within the cast metal component. For example, in one particular embodiment, the mold 100 may be removed from the powder 112 of ceramic material after it has completely solidified to allow the metal material 140 and the mold 100 to cool on its own.

In one embodiment, the molten material may be subjected to an overpressure (e.g., a pressure furnace) or spin casting to provide a force to drive the molten metal material into the mold. Such an overpressure may be especially useful in embodiments where the molten metal material is poured at a temperature that is less than the liquidus temperature. In embodiments where an overpressure is used, a pressure may be formed that is greater than 760 torr to about 3000 torr (e.g., 1000 torr to about 2500 torr) within the chamber 132. Such a pressure may be made with an inert gas (e.g., argon, nitrogen, etc.) so as to prevent oxidation of the cast component.

II. Controlled Growth of Multiple Grain Microstructures

In particular embodiments, the method includes forming cast components with a controlled grain structure therein. For example, the cast component may have multiple sections, each with its own average grain structure therein resulting from the casting process that uses different environmental portions of the mold. In one embodiment, for instance, the method may be utilized to create a cast component having a first section with fine equiaxed grain structures and a second section with elongated grain structures in a single casting process.

Generally, the methods for creating such a cast component involve controlling the temperature at various areas of the mold such that different portions of the mold may have different thermal conditions (e.g. different initial temperatures) when the molten metal material is poured therein. For example, the initial temperature a first portion of the mold in a powder may be different than the initial temperature of a second portion of the mold, which may be different than the initial temperature of a third portion of the mold, etc.

In one embodiment, the methods for creating such a cast component involve surrounding a first portion of the mold in a powder of ceramic material while leaving a second portion of the mold exposed. Additional portions may be included within the mold, as desired. The mold and the powder of ceramic material may then be heated (i.e., preheating the mold), such that the first portion within the powder of ceramic material has an initial first portion temperature that is different than an initial second temperature of the second portion defined by the exposed mold. After heating, a molten metal material may be poured into the mold such that the molten metal material fills the first portion (while in contact with the powder) and the second portion. Then, the molten metal material may be allowed to cool to form a cast component. For example, the mold may be allowed to cool while the first portion of the mold is buried within the powder of ceramic material.

Through this method, the resulting cast component has a grain structure that is predominantly fine grains (e.g., with little to no columnar grain growth therein) within a first section of the cast component that corresponds with the first portion of the mold. Conversely, a second section of the cast component, corresponding to the second portion of the mold, has relatively larger grains therein (e.g., predominantly columnar grains therein). That is, the first section of the cast component may have a first average grain size that is less than a second average grain size within the second section of the cast component. Thus, an integral cast component may be formed with different properties (e.g., grain size) at different areas therein.

Figure 7:
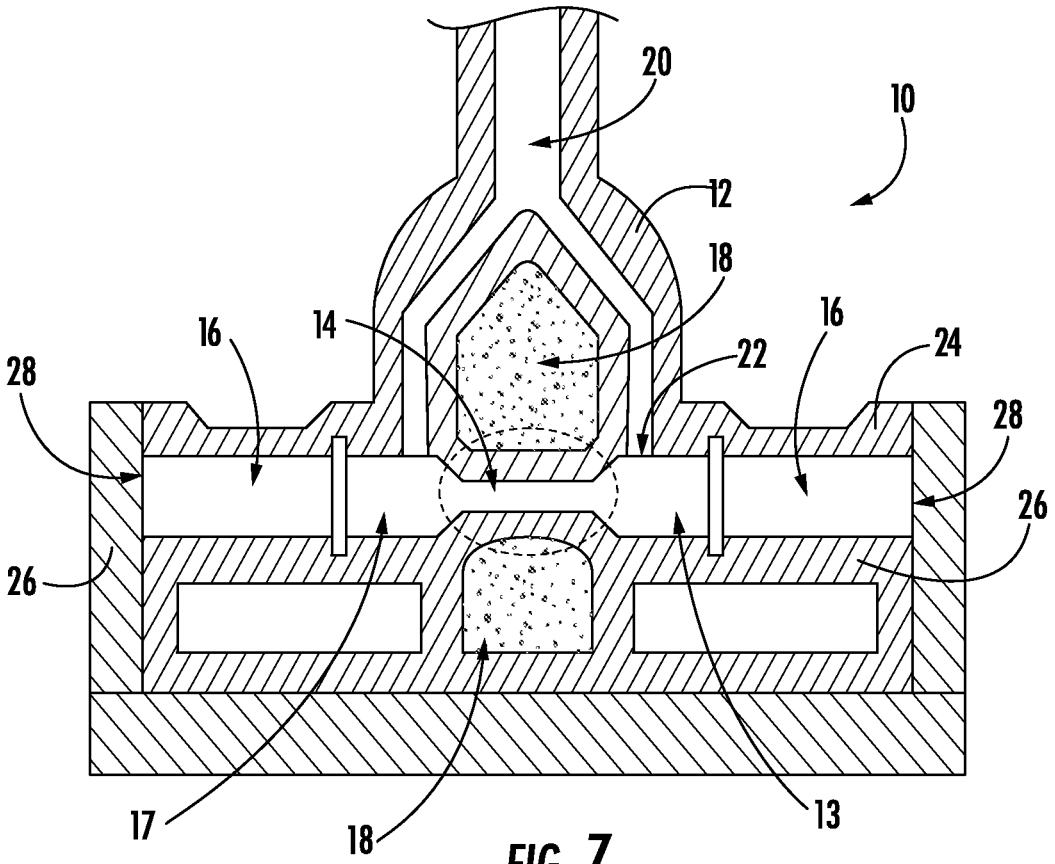
FIG. 7 shows an exemplary casting system for creating a cast component.
Figure 8:
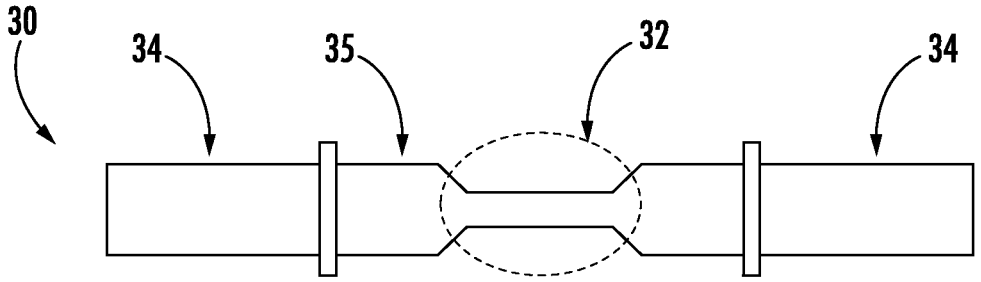
FIG. 8 shows the cast component formed via a method utilizing the casting system of FIG. 7.
Figure 9:
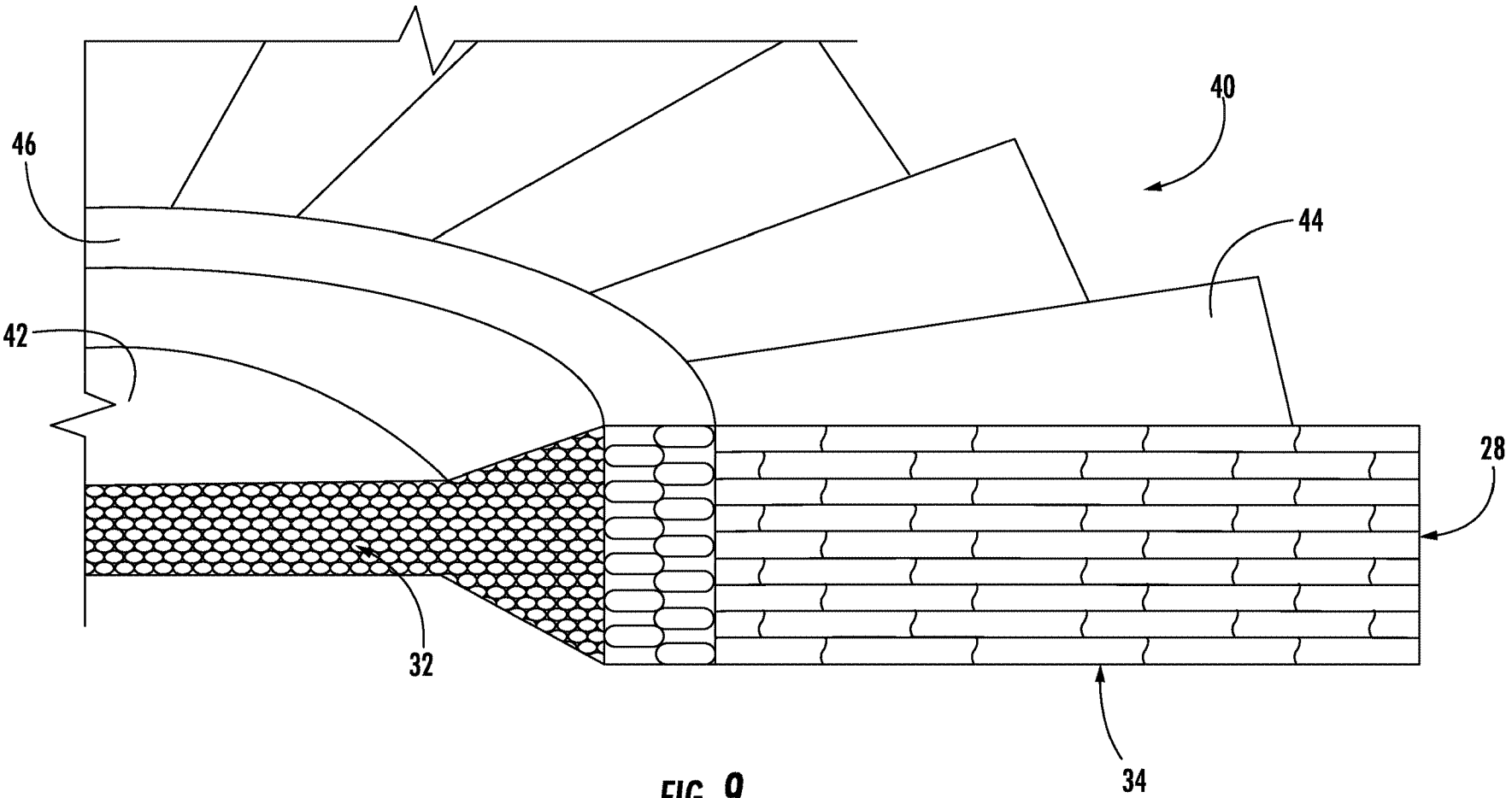
FIG. 9 shows a cross-sectional view of an exemplary bladed disk formed according to methods described herein.

Referring to FIG. 7, a cross-section of a casting system 10 is generally shown for use in the methods of creating a cast component. The casting system 10 includes a mold 12 defining a cavity 13 having a first portion 14 (i.e., a powder surrounded portion, or a "buried" portion) and a second portion 16 (i.e., an exposed portion), and optionally additional portions as desired. The first portion 14 of the mold 12 is surrounded by a powder of ceramic material 18 and the second portion of the mold 12 is exposed (i.e., not in contact with the powder of ceramic material 18). The cavity 13 may further include links spanning therethrough, which result in channels within the resulting cast component (e.g., flow channels within an airfoil).

In one particular embodiment, the ceramic material of the powder is an insulating ceramic material (e.g., insulating ceramic oxides). For example, in one embodiment, the ceramic material of the powder may include alumina (e.g., tabular alumina), which has a relatively high thermal conductivity, as the insulating ceramic material. As such, the insulating ceramic material may keep the first portion 14 of the mold 12 at a lower temperature than the exposed second portion 16 when the molten metal material is poured into the mold 12. Additionally, the insulating ceramic material may provide a path to conduct heat throughout the powder so as to minimize any thermal gradient across the first portion 14 of the mold 12. Other insulating ceramic oxides that may be suitable for use as the ceramic material of the powder include, but are not limited to, zirconia, hafnia, titania, silica, cobalt aluminate, zircon, silica, magnesia, a rare earth oxide (e.g., yttria), or mixtures thereof.

The ceramic material of the powder generally comprises a plurality of ceramic particles (i.e., a powder of ceramic particles). In certain embodiments, the powder has relatively small sized particles (e.g., an average particle size of about 10 mm or less, preferably about 1 mm or less) such that maximum contact can be made with the exterior surfaces of the mold 12. In particular embodiments, the particles may have an average particle size of about 0.25 mm to about 0.85 mm.

In contrast to the first portion 14, the second portion 16 of the mold 12 is exposed to the atmosphere surrounding the mold 12. That is, the second portion 16 is not in contact with the ceramic powder. As such, the second portion 16 of the mold 12 may be heated and cooled more quickly compared to the first portion 14 of the mold 12.

Without wishing to be bound by any particular theory, it is believed that the grain size of the cast component 30 may be tailored and controlled through adjusting location of the ceramic powder 18. Additionally, it is believed that the grain size of the cast component 30 may be further tailored and controlled through adjusting the initial mold temperature, the material temperature of the molten metal material, and/or the elevated mold temperature reached after pouring the metal material therein. In one particular embodiment, the mold 12 may be heated to an initial first mold temperature for the first portion 14 and an initial second mold temperature for the second portion 16. After heating to the initial first mold temperature and second mold temperature, the heat source may be disengaged, and the molten metal material may be poured into the mold 12 while at the initial first mold temperature and initial second mold temperature.

In one embodiment, the initial first mold temperature is half or less of the solidus temperature of the metal material to be poured therein. As used herein, the term "solidus temperature" refers to the generally agreed upon temperature at which the material is completely solid on cooling under equilibrium conditions. In one embodiment, the initial first mold temperature may be 75% of the solidus temperature of the metal material or less (e.g., room temperature of about 20° C. to 75% of the solidus temperature of the metal material). For example, the initial first mold temperature may be 5% of the solidus temperature to 75% of the solidus temperature of the metal material (e.g., 7% to less than 50% of the solidus temperature of the metal material), such as 10% to 25% of the solidus temperature of the metal material. When the initial first mold temperature is half or less of the solidus temperature of the metal material, it is believed that the molten metal material quickly cools from its liquid phase upon being poured into the mold 12. As such, it is believed that the molten metal material may begin to crystalize while it fills the mold such that the molten metal material begins to form its grain structure upon pouring. Without wishing to be bound by any particular theory, it is believed that these grains may serve as seed sites for grain formation at the desired size. Such an embodiment may be particularly useful for components having large cavities to fill with the molten metal material.

While the molten metal is being poured into the cooler mold, it is believed, without wishing to be bound by any particular theory, that thermal energy transfers from the metal material to the mold. In the first portion, the thermal energy transfers to the powder of ceramic material. That is, the metal material cools while the first portion of the mold heats, which in turn causes the ceramic material surrounding the mold to heat. It is believed that the powder of ceramic material has sufficient thermal mass to absorb the heat from the metal material (through the mold), serving as a thermal sink, while providing insulation to the mold to control the cooling rate. On the other hand, the thermal energy transfers to the surrounding atmosphere within the second portion of the mold.

Generally, this controlled solidification process is allowed to occur until the metal material completely solidifies within the mold. As discussed below, the mold may then be quickly cooled, upon complete solidification of the metal material, to inhibit grain growth within the first section of the cast metal component corresponding to the first portion of the mold. During the controlled solidification process, the molten metal material heats the first portion of the mold from its initial first mold temperature (i.e., the temperature of the first portion of the mold when the molten metal material is poured therein) to an elevated first mold temperature upon which the molten metal material is completely solidified within the mold. The elevated first mold temperature may depend on a variety of factors, such as the initial first mold temperature, the volume and/or temperature of the molten metal material at pouring, the amount and/or type of ceramic material present, the size and/or thickness of the mold, etc. For example, in certain embodiments, the elevated first mold temperature may be greater than 25% of the solidus temperature of the metal material (e.g., greater than 25% to 110% of the solidus temperature). For instance, the elevated first mold temperature may be 50% to 85% of the solidus temperature of the metal material (e.g., 60% to 75% of the solidus temperature).

In certain embodiments, the amount of ceramic powder 18 that is present in the cavities surrounding the first portion 14 is greater, in terms of thermal mass, than the amount of metal material poured into the first portion 14. For example, thermal mass ratio may be defined by the volume of ceramic material to the volume of metal material within the first portion 14 of the mold 12. In this definition, the thermal mass ratio may be greater than 1, indicating that there is more thermal mass of the powder than the poured metal material within the first portion 14. In particular embodiments, the thermal mass ratio may be about 2 or greater (e.g., about 5 or greater, such as about 10 or greater).

Conversely, during the controlled solidification process, the molten metal material heats the second portion of the mold from its initial second mold temperature (i.e., the temperature of the second portion of the mold when the molten metal material is poured therein) to an elevated second mold temperature upon which the molten metal material is completely solidified within the mold. The elevated second mold temperature may depend on a variety of factors, such as the initial second mold temperature, the volume and/or temperature of the molten metal material at pouring, the amount and/or type of ceramic material present, the size and/or thickness of the mold, etc. For example, in certain embodiments, the elevated second mold temperature may be greater than 25% of the solidus temperature of the metal material (e.g., greater than 25% to 110% of the solidus temperature). For instance, the elevated second mold temperature may be 50% to 85% of the solidus temperature of the metal material (e.g., 60% to 75% of the solidus temperature).

In particular embodiments, the mold 12 has a wall 24 surrounding a cavity 13 into which the molten metal material flows. The mold wall 24 may have a uniform or non-uniform thickness. For example, the mold wall 24 may have a thickness that ranges from 1 mm to 50 mm (e.g., 2 mm to 10 mm).

The mold 12 may be made out of a ceramic material, which is independently selected from the ceramic material of the powder. For example, the mold 12 may be formed from alumina, zirconia, hafnia, titania, silica, cobalt aluminate, zircon, silica, magnesia, a rare earth oxide, or a mixture thereof.

In certain embodiments, the molten metal material is poured into the mold near its liquidus temperature. As used herein, the term "liquidus temperature" refers to the lowest temperature at which the metal material (e.g., an alloy) is completely liquid. For example, the molten metal material is poured at a pour temperature that may be about 80% of the liquidus temperature to 105% of the liquidus temperature of the metal material, such as about 85% of the liquidus temperature to 105%. When the pour temperature is at or above the liquidus temperature (e.g., 100% to about 105%) of the metal material, it is believed that the molten metal material may stay completely in the liquid phase while the mold is being filled such that the molten metal material completely fills the mold in a substantially uniform manner. Such an embodiment may be particularly useful for components having small structures through which the molten metal material fills. Alternatively, when the pour temperature is below the liquidus temperature (e.g., about 80% to less than 100%, such as about 90% to less than 100% or about 95% to less than 100%) of the metal material, it is believed that the molten metal material may begin to crystalize while it fills the mold such that the molten metal material begins to form its grain structure upon pouring. That is, crystals may form within the molten metal material, when the pour temperature is lower than the liquidus temperature, such that smaller grains already started forming prior to the rest of the material crystalizing. Without wishing to be bound by any particular theory, it is believed that these grains may serve as seed sites for grain formation at the desired size. Such an embodiment may be particularly useful for components having large cavities to fill with the molten metal material.

In one embodiment, the metal material may include, but is not limited to, pure metals, nickel alloys, chrome alloys, iron alloys, titanium, titanium alloys, magnesium, magnesium alloys, aluminum, aluminum alloys, nickel-based superalloys, cobalt-based superalloys, iron-based superalloys or mixtures thereof.

Referring again to FIG. 7, a supply line 20 is fluidly connected to the cavity 13 of the mold 12 to supply molten metal material to the cavity 13. As shown, the supply line 20 may be formed as part of the mold 12 and may be connected to the cavity 13 at multiple inlets 22. As such, the molten metal material may be simultaneously supplied into the cavity 13 at various multiple locations.

The mold 12 forms a cast component 30, such as shown in FIG. 2 upon cooling. Generally, the first portion 14 of the mold 12 generally corresponds to a first section 32 (e.g., an internal section as shown) of the cast component 30, and the second portion 16 of the mold 12 generally corresponds to a second section 34 (e.g., an outer section as shown) of the cast component 30.

Without wishing to be bound by any particular theory, it is believed that the methods described herein may help achieve significantly fine grain structure within the first section of the cast component, corresponding to the first portion of the mold, by decreasing the thermal gradient within the metal material during final solidification. Without wishing to be bound by any particular theory, it is believed that the ceramic bed provides a medium into which the thermal gradient is formed surrounding the first portion, outside of the mold, to allow for more unified cooling within the first portion of the mold. That is, a thermal gradient can be formed within the powder of ceramic material around the first portion after pouring the molten metal material into the mold, such that the thermal gradient essentially shifts from the metal material within the first portion of the mold and into the ceramic powder outside of the mold. As such, the resultant grain structure within the first section of the cast component has a substantially uniform grain structure across thin and thick sections with little to no columnar grain growth.

Conversely, the second portion may include grain sizes that are larger in size than the grain sizes in the first portion. In one particular embodiment, the grain size within the second portion may have an aspect ratio (i.e., the longest measurement of the grain divided by the smallest measurement of the grain) that is relatively large compared to that of the grains in the first portion. That is, the grains within the second portion may be columnar in nature. In particular embodiments, the grains within the second portion may have an aspect ratio of 2 or greater (e.g., of 3 or greater, such as 3 to 25). The first portion may include, in one embodiment, a single crystal grown from a starter seed crystal within the cavity 13 within the first portion.

In one embodiment, at least one edge of the second portion may be cooled during the solidification. Without wishing to be bound by any particular theory, it is believed that a temperature gradient may be formed within the second portion of the mold to create columnar grains extending in the direction toward the cooling source (e.g., a chiller). Referring to FIG. 7, for example, a chiller 26 may be positioned on the outer edge 28 of the second portion 16 so as to orient the columnar grains radially in this particular embodiment of the cast component 30.

In particular embodiments, the chiller 26 may reduce the temperature of the edge 28 to a temperature that is less than the initial second mold temperature of the second portion 16 of the mold 12. For example, the chiller 26 may be a liquid-cooled plate (e.g., a water-cooled copper plate). The temperature of the chiller 26 may be controlled for the component being created by the casting process. However, in most embodiments, the chiller 26 has a chiller temperature that is less than the temperature of the powder 18, less than the initial first mold temperature of the first portion 14 of the mold 12, and/or less than the initial second mold temperature of the second portion 16 of the mold 12. In particular embodiments, the chiller 26 has a chiller temperature that is at least 10% lower than the initial second mold temperature of the second portion 16 of the mold 12, such as at least 20% lower than the initial second mold temperature of the second portion 16 of the mold 12.

The chiller 26 may be engaged before pouring of the molten metal material, during pouring of the molten metal material, and/or after pouring of the molten metal material.

In particular embodiments, the chiller 26 is engaged as the pouring of the molten metal material begins (i.e., substantially simultaneously with the introduction of the molten metal material to the mold 12) and remains engaged during solidification of the molten metal material within the mold 12.

For example, the cast component 30 may have a grain structure within the first portion 14 that has an average grain size of about 250 micrometers (μm) or less, such as about 10 μm to about 250 μm (e.g., about 25 μm to about 200 μm, or about 25 μm to about 100 μm). Additionally, the grains within the first portion 14 may have an average grain size and shape with a relatively low aspect ratio, such as 2 or less (e.g., 0.5 to 2). Alternatively, the cast component 30 may have a grain structure within the second portion 16 that has a larger average grain size than the average grain size within the first portion 14. The grains within the second portion 16 may also have an aspect ratio of 2 or greater, as discussed above, such that the grains within the second portion have a more columnar shape than the grains within the first portion 14.

In additional embodiments, a third portion 17 (i.e., an intermediate portion or a transition portion) of the mold 12 may form a transition section 35 within the cast component having more grains that are larger than the grains of the first section 32 formed within the first portion 14, but less columnar than the grains within the second section 34 formed within the second portion 16. That is, the grains of the first section 32 have an average aspect ratio that is less than the average aspect ratio of the grains of the second section 34.

Referring to FIG. 3, the casting system 10 is shown within an exemplary vacuum melter 130 as described above. The crystal structure and grain size may also be impacted by various combinations of gating, shelling, other mold insulation (e.g. Kaowool, Fiberfrax, graphite baffles), vibration, chills, heater designs, or cooling gases (e.g. Air, Argon, Helium, Nitrogen) during the casting cycle to affect the resultant crystal structure as well.

Such control of the grain structure of the cast component allows the designer to tailor the properties of the component depending on the location (portion) of the component. For example, a finer grain structure within the first section may allow for improved strength and cyclic capability. Conversely, a more columnar grain structure within the second section may allow for improved time dependent mechanical properties (e.g., creep deformation). This type of control is particularly suitable for rotary components used, for example, in turbine engines.

While the presently disclosed methods are suitable for a variety of applications, the methods are particularly suitable for forming cast components found in high temperature environments, such as those present in gas turbine engines, for example, combustor components, turbine blades, shrouds, nozzles, heat shields, and vanes. As stated above, the methods described herein are particularly useful for forming cast components for rotary machines, such as turbine engines. For example, a bladed disk may be formed with the first section corresponding to an internal disk area and the second section corresponding to the airfoils extending radially outwardly from the disk.

III. Exemplary Applications of Cast Components

Figure 4:
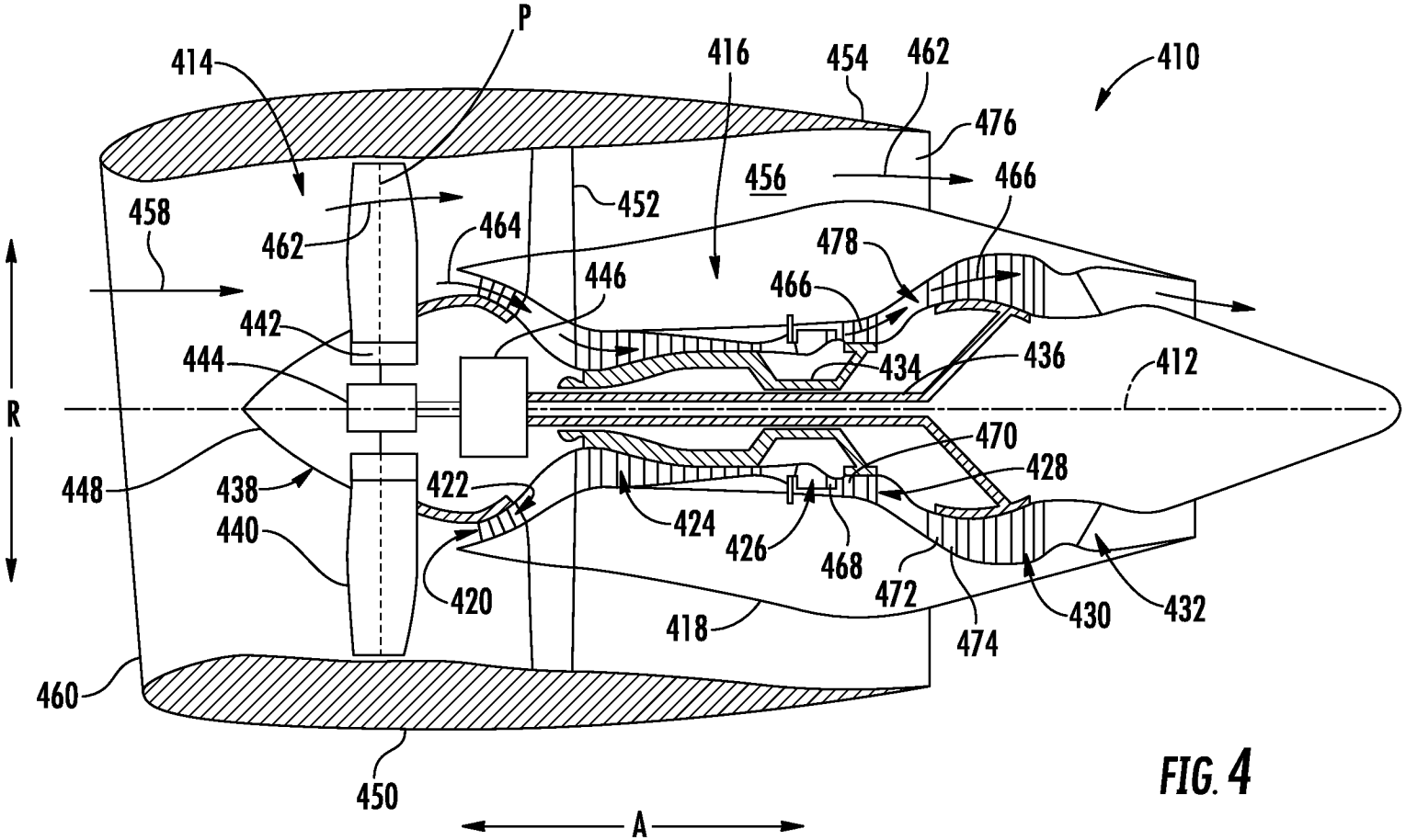
FIG. 4 shows a schematic cross-sectional view of an exemplary gas turbine engine that may use a component cast according to embodiments described herein.

While the presently disclosed methods are suitable for a variety of applications, the methods are particularly suitable for forming cast components found in high temperature environments, such as those present in gas turbine engines, for example, combustor components, turbine blades, shrouds, nozzles, heat shields, and vanes. FIG. 4 is a schematic cross-sectional view of a gas turbine engine in accordance with an exemplary embodiment of the present disclosure. More particularly, for the embodiment of FIG. 4, the gas turbine engine is a high-bypass turbofan jet engine 410, referred to herein as "turbofan engine 410." As shown in FIG. 4, the turbofan engine 410 defines an axial direction A (extending parallel to a longitudinal centerline 412 provided for reference) and a radial direction R. In general, the turbofan 410 includes a fan section 414 and a core turbine engine 416 disposed downstream from the fan section 414. Although described below with reference to a turbofan engine 410, the present disclosure is applicable to turbomachinery in general, including turbojet, turboprop and turboshaft gas turbine engines, including industrial and marine gas turbine engines and auxiliary power units.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across an optional power gear box 46. The power gear box 46 includes a plurality of gears for stepping down the rotational speed of the LP shaft 36 to a more efficient rotational fan speed.

Referring still to the exemplary embodiment of FIG. 4, the disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

Further aspects of the invention are provided by the subject matter of the following clauses:

A method of creating a cast alloy component from a metal material having a solidus temperature and a liquidus temperature, comprising: burying a mold in a powder of ceramic material; heating the mold within the powder of ceramic material to an initial mold temperature that is 50% or less of the solidus temperature of the metal material; while the mold is at the initial mold temperature, pouring molten metal material into the mold buried within the powder of ceramic material; and thereafter, allowing the molten metal material to form the cast alloy component within the mold buried within the powder of ceramic material.

The method of any preceding clause, wherein the cast alloy component has a grain size of 250 micrometers or less, and wherein the powder of ceramic material comprises alumina, zirconia, hafnia, titania, silica, cobalt aluminate, zircon, silica, magnesia, a rare earth oxide, or a mixture thereof.

The method of any preceding clause, wherein the powder of ceramic material has a thermal mass such that a thermal mass ratio, defined by the volume of ceramic material to the volume of metal material within the mold, is greater than 1.

The method of any preceding clause, wherein the thermal mass ratio is 5 or greater.

The method of any preceding clause, wherein the initial mold temperature is 20° C. to 50% of the solidus temperature of the metal material when the metal is poured into the mold.

The method of any preceding clause, wherein the initial mold temperature is 5% of the solidus temperature of the metal material to 50% of the solidus temperature of the metal material when the metal is poured into the mold.

The method of any preceding clause, wherein the initial mold temperature is 7% of the solidus temperature of the metal material to 30% of the solidus temperature of the metal material when the metal is poured into the mold.

The method of any preceding clause, wherein the initial mold temperature is 10% of the solidus temperature of the metal material to 25% of the solidus temperature of the metal material when the metal is poured into the mold.

The method of any preceding clause, further comprising: after heating the mold and prior to pouring the molten metal material into the mold, disengaging any heat source from the mold and powder of ceramic material such that the molten metal material forms the cast alloy component without any application of heat from a heat source.

The method of any preceding clause, wherein allowing the molten metal material to form the cast alloy component involves allowing the molten metal material to cool until solidified while heating the mold to an elevated mold temperature through thermal transfer from the molten metal material to the mold.

The method of any preceding clause, wherein the molten metal material is poured into the mold while in a chamber defined within a vacuum induction melter, wherein the chamber of the vacuum induction melter has an atmosphere having a pressure of that is less than 1 atm.

The method of any preceding clause, wherein cooling the molten metal material comprises: removing the mold buried within the powder of ceramic material from the vacuum induction melter after the molten metal material is poured therein; allowing the molten metal material to heat the mold while buried within the powder of ceramic material until the molten metal material is completely solidified within the mold; and thereafter, removing the mold from the powder of ceramic material and allowing the mold to cool.

The method of any preceding clause, wherein allowing the mold to cool is performed while subjecting the mold to an overpressure.

The method of any preceding clause, wherein the overpressure is formed using a cooling atmosphere having a pressure of greater than 760 torr to about 3000 torr, and wherein the cooling atmosphere comprises an inert gas.

The method of any preceding clause, wherein the overpressure is formed using a spin caster to provide force to drive the molten metal material into the mold.

The method of any preceding clause, wherein the powder comprises ceramic particles having an average particle size of about 1 cm or less.

The method of any preceding clause, wherein the metal material is an alloy or a superalloy.

The method of any preceding clause, wherein the mold is constructed from a ceramic material.

The method of any preceding clause, wherein the ceramic material of the mold has a different composition than the ceramic material of the powder.

The method of any preceding clause, wherein the ceramic material of the mold comprises an insulating ceramic oxide.

A method of creating a cast component, the method comprising: heating a mold under controlled conditions such that a first portion of the mold has a first thermal condition and a second portion of the mold has a second thermal condition that is different than the first thermal condition; after the mold is heated, pouring molten metal material into the mold such that the molten metal material fills the first portion and the second portion of the mold; and thereafter, allowing the molten metal material to form the cast component.

A method of creating a cast component, the method comprising: surrounding a first portion of a mold in a powder of ceramic material while leaving a second portion of the mold exposed; heating the mold and the powder of ceramic material; after the mold is heated, pouring molten metal material into the mold such that the molten metal material fills the first portion and the second portion of the mold; and thereafter, allowing the molten metal material to form the cast component.

The method of any preceding clause, wherein the mold is heated such that the first portion has an initial first portion temperature and such that the second portion has an initial second temperature that is different than the initial first portion temperature.

The method of any preceding clause, wherein the initial second temperature is greater than the initial first portion temperature.

The method of any preceding clause, wherein the cast component has a first section corresponding to the first portion of the mold and having a first average grain size therein, and wherein the cast component has a second section corresponding to the second portion of the mold and having a second average grain size therein; wherein the first average grain size is less than the second average grain size.

The method of any preceding clause, further comprising: cooling an edge of the second portion of the mold.

The method of any preceding clause, wherein the edge of the second portion of the mold is cooled such that a temperature gradient exists within the second portion of the mold.

The method of any preceding clause, wherein the cast component has a first section corresponding to the first portion of the mold and having a first average grain size therein, and wherein the cast component has a second section corresponding to the second portion of the mold and having a second average grain size therein; wherein the second average grain size has a higher average aspect ratio than the first average grain size.

The method of any preceding clause, wherein the second average grain size is more columnar than the first average grain size.

The method of any preceding clause, wherein the first average grain size is 250 micrometers or less.

The method of any preceding clause, further comprising: after heating the mold and prior to pouring the molten metal material into the mold, disengaging any heat source from the mold such that the molten metal material forms the cast component without any application of heat from a heat source.

The method of any preceding claim, wherein the molten metal material is poured into the mold while in a chamber defined within a vacuum melter, wherein the chamber of the vacuum melter has an atmosphere having a pressure of that is less than 1 atm.

The method of any preceding clause, wherein the powder of ceramic material comprises alumina, zirconia, hafnia, titania, silica, cobalt aluminate, zircon, silica, magnesia, a rare earth oxide, or a mixture thereof.

The method of any preceding clause, wherein the powder of ceramic material has a thermal mass such that a thermal mass ratio, defined by the volume of ceramic material to the volume of metal material within the mold, is greater than 1.

The method of any preceding clause, wherein cooling the molten metal material comprises: removing the mold from the powder of ceramic material from the vacuum melter after the molten metal material is poured therein; allowing the molten metal material to heat the mold while the first portion is buried within the powder of ceramic material until the molten metal material is completely solidified within the mold; and thereafter, removing the mold from the powder of ceramic material and allowing the mold to cool.

The method of any preceding clause, wherein allowing the mold to cool is performed while subjecting the mold to an overpressure.

The method of any preceding clause, wherein the overpressure is formed using a cooling atmosphere having a pressure of greater than 760 torr to about 3000 torr, and wherein the cooling atmosphere comprises an inert gas.

The method of any preceding clause, wherein the overpressure is formed using a spin caster to provide force to drive the molten metal material into the mold.

The method of any preceding clause, wherein the powder comprises ceramic particles having an average particle size of about 1 cm or less.

The method of any preceding clause, wherein the metal material is an alloy or a superalloy.

The method of any preceding clause, wherein the metal material has a solidus temperature and a liquidus temperature, and wherein the mold is heated such that the first portion is heated to an initial first portion temperature that is 75% or less of the solidus temperature of the metal material.

The method of any preceding clause, wherein the mold is constructed from a ceramic material.

The method of any preceding clause, wherein the mold is constructed from a ceramic material, and wherein the ceramic material of the mold has a different composition than the ceramic material of the powder.

The method of any preceding clause, wherein the ceramic material of the mold comprises an insulating ceramic oxide.

A cast component comprising a metal alloy, wherein the cast component defines a first section having first grains with a first average grain size and a second section having second grains with a second average grain size, wherein the first average grain size is less than the second average grain size.

The cast component of any preceding clause, wherein the second grains have an average second aspect ratio that is greater than an average first aspect ratio of the first grains.

The cast component of any preceding clause, wherein the second average grain size has an aspect ratio of 2 or greater.

The cast component of any preceding clause wherein the second average grain size has an aspect ratio of 3 or greater.

The cast component of any preceding clause, wherein the first average grain size has an aspect ratio of 2 or less.

A cast component comprising a metal alloy, wherein the cast component defines a first section having first grains with a first average grain size and a second section having a single crystal, wherein the first average grain size is 250 micrometers or less.

The cast component of any preceding clause, further defining a third section having third grains with a third average grain size, wherein the third average grain size is greater than the first average grain size.

The cast component of any preceding clause, wherein the third average grain size is less than the second average grain size.

A bladed disk comprising an internal disk having a plurality of airfoils extending radially outward therefrom, wherein the bladed disk comprises a cast metal alloy having a plurality of first grains with a first average grain size within the internal disk and a plurality of second grains with a second average grain size within the plurality of airfoils, wherein the first average grain size is less than the second average grain size.

The bladed disk of any preceding clause, wherein the cast metal alloy further has a plurality of third grains with a third average grain size in a transition section between the internal disk and the plurality of airfoils, wherein the third average grain size is larger than the first average grain size.

Example

A ceramic mold was completely buried into a powder of ceramic material. The ceramic mold was made of alumina, and the powder of ceramic material was composed of alumina. The powder of ceramic material was surrounded within a container, which was heated in a furnace at 2395° F. (1312.8° C.) for 30 minutes in a vacuum.

Figure 5:
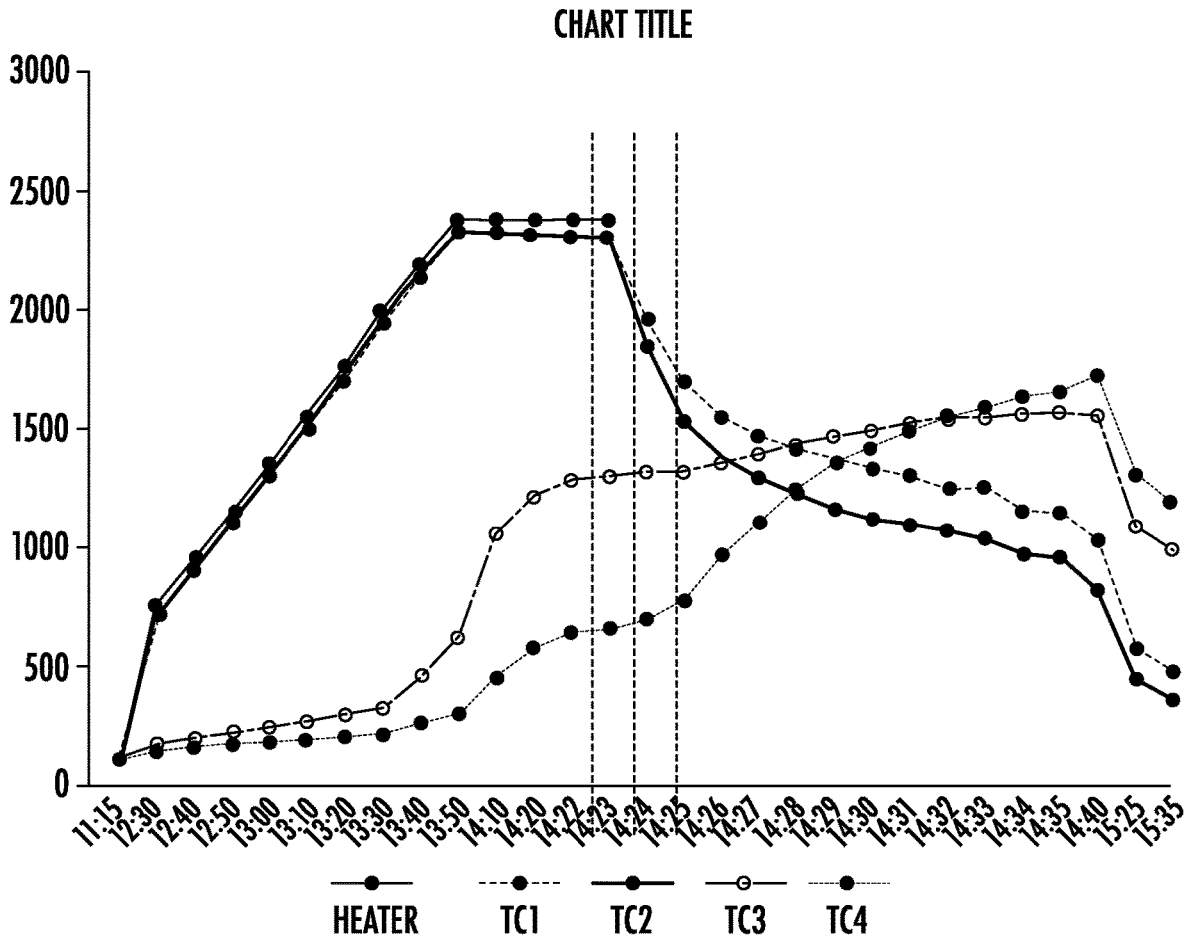
FIG. 5 shows a chart of temperatures at various locations within a cast method according to the Example discussed below.

Temperature sensors were placed at varying distances from the mold within the powder, and the temperature was tracked during the heating process and casting process. FIG. 5 shows the temperatures at various locations during the heating and casting process.

Figure 6:
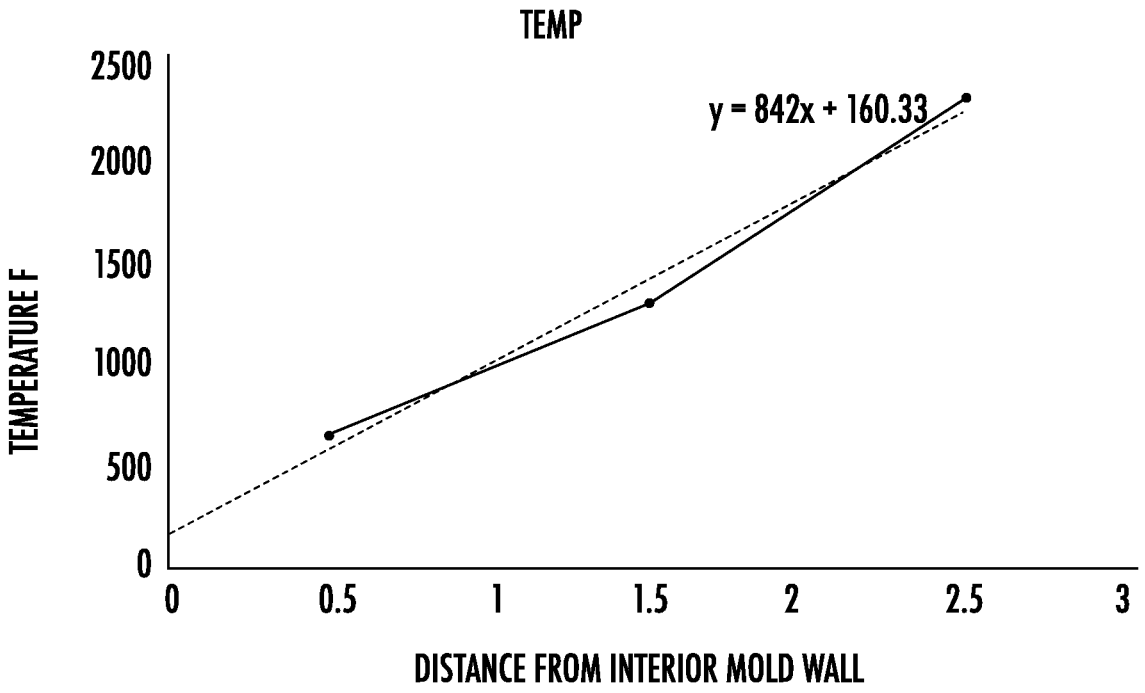
FIG. 6 shows an exemplary temperature gradient of a powder of ceramic material used according to the Example discussed below.

FIG. 6 shows an extrapolation of the temperature gradient within the ceramic powder at the initial temperature (i.e., at the time when the metal is poured into the mold).

This written description uses exemplary embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of creating a cast alloy component from a metal material having a solidus temperature and a liquidus temperature, comprising:

burying a mold in a powder of ceramic material;

heating the mold within the powder of ceramic material to an initial mold temperature that is 50% or less in degrees Celsius of the solidus temperature of the metal material;

thereafter, pouring molten metal material into the mold buried in the powder of ceramic material; and thereafter, allowing the molten metal material to form the cast alloy component within the mold buried within the powder of ceramic material.

2. The method of claim 1, wherein the cast alloy component has an average grain size of 250 micrometers or less, and wherein the powder of ceramic material comprises alumina, zirconia, hafnia, titania, silica, cobalt aluminate, zircon, silica, magnesia, a rare earth oxide, or a mixture thereof.

3. The method of claim 1, wherein the molten metal material is poured into the mold while in a chamber defined within a vacuum induction melter, wherein the chamber of the vacuum induction melter has an atmosphere having a pressure of that is less than 1 atm.

4. The method of claim 3, wherein allowing the molten metal material to form the cast alloy component comprises:

removing the mold buried within the powder of ceramic material from the vacuum induction melter after the molten metal material is poured therein;

allowing the molten metal material to heat the mold while buried within the powder of ceramic material until the molten metal material is completely solidified within the mold; and thereafter, removing the mold from the powder of ceramic material and allowing the mold to cool.

5. The method of claim 1, further comprising removing the mold from the powder of ceramic material and allowing the mold to cool.

6. A method of creating a cast alloy component from a metal material having a solidus temperature and a liquidus temperature, comprising:

burying at least a first portion of a mold in a powder of ceramic material;

heating the mold within the powder of ceramic material under controlled conditions such that the first portion of the mold has an initial first portion temperature and a second portion of the mold has an initial second portion temperature that is different than the initial first portion temperature;

thereafter, pouring molten metal material into the mold while the first portion is buried in the powder of ceramic material such that the molten metal material fills the first portion and the second portion of the mold; and thereafter, allowing the molten metal material to form the cast alloy component within the mold while the first portion is buried within the powder of ceramic material.

7. The method of claim 6, wherein the initial second temperature is greater than the initial first portion temperature.

8. The method of claim 6, wherein the cast alloy component has a first section corresponding to the first portion of the mold and having a first average grain size therein, and wherein the cast alloy component has a second section corresponding to the second portion of the mold and having a second average grain size therein; wherein the first average grain size is less than the second average grain size.

9. The method of claim 6, further comprising:

cooling an edge of the second portion of the mold, wherein the edge of the second portion of the mold is cooled such that a temperature gradient exists within the second portion of the mold.

10. The method of claim 6, wherein the cast alloy component has a first section corresponding to the first portion of the mold and having a first average grain size therein, and wherein the cast alloy component has a second section corresponding to the second portion of the mold and having a second average grain size therein; wherein the second average grain size has a higher average aspect ratio than the first average grain size, and wherein the second average grain size is more columnar than the first average grain size.

11. The method of claim 6, wherein the metal material is an alloy or a superalloy, wherein the mold is constructed from a ceramic material, and wherein the ceramic material of the mold has a different composition than the ceramic material of the powder of ceramic material.

12. The method of claim 11, wherein the ceramic material of the mold comprises an insulating ceramic oxide.

13. A method of creating a cast alloy component from a metal material having a solidus temperature and a liquidus temperature, comprising:

burying at least a first portion of a mold in a powder of ceramic material;

heating the mold within the powder of ceramic material;

thereafter, pouring molten metal material into the mold while the first portion is buried in the powder of ceramic material;

thereafter, allowing the molten metal material to form the cast alloy component within the mold while the first portion is buried within the powder of ceramic material; and removing the mold from the powder of ceramic material and allowing the mold to cool while subjecting the mold to an overpressure.

14. The method of claim 13, wherein the overpressure is formed using a cooling atmosphere having a pressure of greater than 760 torr.

15. The method of claim 13, wherein the overpressure is formed using a spin caster to provide force to drive the molten metal material into the mold.

* * * * *